US007781071B2

(12) United States Patent
Parson et al.

(10) Patent No.: US 7,781,071 B2
(45) Date of Patent: Aug. 24, 2010

(54) ALUMINUM ALLOY TUBE AND FIN ASSEMBLY FOR HEAT EXCHANGERS HAVING IMPROVED CORROSION RESISTANCE AFTER BRAZING

(75) Inventors: Nicholas Charles Parson, Kingston (CA); Alan Gray, Banbury (GB); Pierre Henri Marois, Kingston (CA); Thiagarajan Ramanan, North Royalton, OH (US)

(73) Assignee: Alcan International Limited, Montreal (CA)

( * ) Notice: Subject to any disclaimer, the term of this patent is extended or adjusted under 35 U.S.C. 154(b) by 1168 days.

(21) Appl. No.: 10/539,722

(22) PCT Filed: Dec. 22, 2003

(86) PCT No.: PCT/CA03/02002

§ 371 (c)(1),
(2), (4) Date: Apr. 13, 2006

(87) PCT Pub. No.: WO2004/057261

PCT Pub. Date: Jul. 8, 2004

(65) Prior Publication Data

US 2006/0231170 A1 Oct. 19, 2006

Related U.S. Application Data

(60) Provisional application No. 60/436,022, filed on Dec. 23, 2002.

(51) Int. Cl.
*F28F 19/02* (2006.01)
*F28F 21/08* (2006.01)
*B32B 15/20* (2006.01)

(52) U.S. Cl. ..... 428/654; 165/180; 165/905

(58) Field of Classification Search ..... None
See application file for complete search history.

(56) References Cited

U.S. PATENT DOCUMENTS

| | | | | |
|---|---|---|---|---|
| 3,878,871 | A | 4/1975 | Anthony et al. | |
| 4,357,397 | A * | 11/1982 | Baba et al. | 428/654 |
| 4,620,590 | A * | 11/1986 | Koisuka et al. | 165/150 |
| 4,991,647 | A | 2/1991 | Kawabe et al. | |
| 5,351,750 | A * | 10/1994 | Garcia | 165/133 |
| 5,785,776 | A | 7/1998 | Sircar | |
| 5,906,689 | A | 5/1999 | Sircar | |
| 5,976,278 | A | 11/1999 | Sircar | |

(Continued)

FOREIGN PATENT DOCUMENTS

| | | |
|---|---|---|
| EP | 0 893 512 | 1/1999 |

(Continued)

*Primary Examiner*—Aaron Austin
(74) *Attorney, Agent, or Firm*—RatnerPrestia

(57) ABSTRACT

The present invention provides extruded tubes for heat exchangers having improved corrosion resistance when used alone and when part of a brazed heat exchanger assembly with compatible finstock. The tubes are formed from a first aluminum alloy containing 0.4 to 1.1% by weight manganese, up to 0.01% by weight copper, up to 0.05% by weight zinc, up to 0.2% by weight iron, up to 0.2% by weight silicon, up to 0.01% by weight nickel, up to 0.05% by weight titanium and the balance aluminum and incidental impurities. The fins are formed from a second aluminum alloy containing 0.9 to 1.5% by weight manganese or an alloy of the AA3003 type, this second aluminum alloy further containing at least 0.5% by weight zinc.

6 Claims, 2 Drawing Sheets

U.S. PATENT DOCUMENTS

| | | | | |
|---|---|---|---|---|
| 6,284,386 | B1 | 9/2001 | Jeffrey et al. | |
| 6,391,129 | B1 | 5/2002 | Hurd et al. | |
| 6,408,938 | B2 | 6/2002 | Gray et al. | |
| 6,921,584 | B2 * | 7/2005 | Syslak et al. | 428/654 |
| 2002/0007881 | A1 | 1/2002 | Daaland et al. | |

FOREIGN PATENT DOCUMENTS

| | | | |
|---|---|---|---|
| EP | 0 899 350 | | 3/1999 |
| EP | 1 158 063 | A1 | 11/2001 |
| EP | 1 254 965 | A1 | 11/2002 |
| GB | 2 321 255 | A | 5/1997 |
| WO | WO 01/66812 | | 9/2001 |
| WO | WO 02090031 | A2 * | 11/2002 |

* cited by examiner

ALUMINUM ALLOY TUBE AND FIN ASSEMBLY FOR HEAT EXCHANGERS HAVING IMPROVED CORROSION RESISTANCE AFTER BRAZING

CROSS-REFERENCE TO RELATED APPLICATIONS

This application is a National Stage entry of PCT/CA03/02002, filed Dec. 22, 2003, which claims priority from U.S. Provisional Application No. 60/436,022, filed Dec. 23, 2002.

TECHNICAL FIELD

This invention relates to extruded aluminum alloy products of improved corrosion resistance. It particularly relates to extruded tubes for heat exchangers having improved corrosion resistance after brazing when paired with a compatible finstock.

BACKGROUND ART

Commercially produced aluminum microport tubing for use in brazed applications is generally produced in the following manner. The extrusion ingot is cast and optionally homogenized by heating the metal to an elevated temperature and then cooling in a controlled manner. The ingot is then reheated and extruded into microport tubing. This is generally thermally sprayed with zinc before quenching, drying and coiling. The coils are then unwound, straightened and cut to length. The tubes obtained are then stacked with corrugated fins clad with filler metal between each tube and the ends are then inserted into headers. The assemblies are then banded, fluxed and dried.

The assemblies can be exposed to a braze cycle in batch or tunnel furnaces. Generally, most condensers are produced in tunnel furnaces. The assemblies are placed on conveyor belts or in trays that progress through the various sections of the furnace until they reach the brazing zone. Brazing is carried out in a nitrogen atmosphere. The heating rate of the assemblies depends on the size and mass of the unit but the heating rate is usually close to 20° C./min. The time and temperature of the brazing cycle depends on the part configuration but is usually carried out between 595 and 610° C. for 1 to 30 minutes.

A difficulty with the use of aluminum alloy products in corrosive environments, such as automotive heat exchanger tubing, is pitting corrosion. Once small pits start to form, corrosion actively concentrates in the region of the pits, so that perforation and failure of the alloy occurs much more rapidly than it would if the corrosion were more general. With such a large cathode/anode area ratio, the dissolution rate at the active sites is very rapid and tubes manufactured from conventional alloys can perforate rapidly, for example in 2-6 days in the SWAAT test.

Zinc coating applied to the tube after extrusion acts to inhibit corrosion of the tube itself. However during the braze cycle, the Zn layer on the extruded tube starts to melt at around 450° C. and once molten, is drawn into the fillet/tube joint through capillary action. This occurs before the Al—Si cladding (fin material) melts at approximately 570° C. and as result the tube-to-fin fillet becomes enriched with Zn, rendering it electrochemically sacrificial to the surrounding fin and tube material. A problem with thermally spraying with zinc before brazing is therefore that the braze fillets become zinc enriched and tend to be the first parts of the units to corrode. As a result, the fins become detached from the tubes, reducing the thermal efficiency of the heat exchanger. In addition to these physical effects, any enrichment of the fillet region with Zn has the effect of reducing the thermal conductivity of the prime heat transfer interface between the tube/fin. There is also a desire to move away from the use of zinc for cost savings and for workplace environment reasons.

In an assembly of brazed tubes and fins, it has been found to be advantageous to have the fins corrode first and thereby galvanically protect the tubes. Most fin alloys used with extruded tubes are clad alloys where the core alloys are either 3XXX or 7XXX series alloy based and contain some zinc to make them electronegative, and thereby provide this type of protection. By making the fin sufficiently electronegative, the tubes to which the fins are brazed can be protected, in this way, if the zinc content of the fin is raised sufficiently. However, this has a negative impact on the thermal conductivity of the fin and on the ultimate recyclability of the unit. Furthermore, if the fin material is too electronegative it can corrode too fast and thereby compromises the thermal performance of the entire heat exchanger. Corrosion potential and the difference between corrosion potential of tube and fin have been frequently used to select tube and fin alloys to be galvanically compatible (so that the fin corrodes before the tube). This technique serves to give an approximate galvanic ranking. In order to obtain a true determination of the performance of such combinations it has been found that a measurement of the direction and magnitude of the galvanic current permits a better determination of ultimate performance. Little attempt has been made to optimize the tube-fin combination in heat exchangers based on extruded tubes through the use of appropriate alloys alone, the use of zinc cladding being widely used instead. One constraint on such optimization is that it still also must be possible to extrude the tubes without difficulty.

Anthony et al., U.S. Pat. No. 3,878,871, issued Apr. 22, 1975, describes a corrosion resistant aluminum alloy composite material comprising an aluminum alloy core containing from 0.1 to 0.8% manganese and from 0.05 to 0.5% silicon, and a layer of cladding material which is an aluminum alloy containing 0.8 to 1.2% manganese and 0.1 to 0.4% zinc.

Sircar, U.S. Pat. No. 5,785,776, issued Jul. 28, 1998, describes a corrosion resistant AA3000 series aluminum alloy containing controlled amounts of copper, zinc and titanium. It has a titanium content of 0.03 to 0.30%, but this level of titanium raises the pressures required for extrusion, which will ultimately lower productivity.

In Jeffrey et al., U.S. Pat. No. 6,284,386, issued Sep. 4, 2001, extruded aluminum alloy products having a high resistance to pitting corrosion are described in which the alloy contains about 0.001 to 0.3% zinc and about 0.001 to 0.03% titanium. The alloys preferably also contain about 0.001 to 0.5% manganese and about 0.03 to 0.4% silicon. These extruded products are particularly useful in the form of extruded tubes for mechanically assembled heat exchangers.

It is an object of the present invention to provide brazed extruded aluminum alloy tubing for heat exchangers having adequate corrosion resistance without special treatments, such as thermal spraying of the surface with zinc, and also being galvanically compatible with fins joined thereto.

It is a further object of the present invention to provide a brazed heat exchanger assembly consisting of extruded tubing and fins in which the tubing alloy is optimized to minimize self corrosion and so that the heat exchanger is protected from overall corrosion by a slow corrosion of the fins.

DISCLOSURE OF THE INVENTION

The present invention in one embodiment relates to an aluminum alloy for an extruded heat exchanger tube comprising 0.4 to 1.1% by weight manganese, preferably 0.6 to 1.1% by weight manganese, up to 0.01% by weight copper, up to 0.05% by weight zinc, up to 0.2% by weight iron, up to 0.2% by weight silicon, up to 0.01% by weight nickel, up to 0.05% by weight titanium and the balance aluminum and incidental impurities.

Further embodiments comprise an extruded tube made from the above alloy and such a tube when brazed.

In a yet further embodiment, the invention relates to a brazed heat exchanger comprising joined heat exchanger tubes and heat exchanger fins, where the tubes are extruded tubes made from a first alloy comprising the aluminum alloy described above and the fins are formed from a second alloy comprising an aluminum alloy containing about 0.9 to 1.5% by weight Mn and at least 0.5% by weight Zn, or an aluminum alloy of the AA3003 type, with this second alloy further containing at least 0.5% by weight zinc.

Fin alloys of this type have sufficient mechanical properties to meet the heat exchanger construction requirements.

It appears that the above unique combination of alloying elements for the tubes gives unexpectedly good self anti-corrosion results for the tubes without the need for any coating of zinc. Also by keeping the manganese content of the tube alloy within 0.8% by weight of that of the fin or greater than or equal to the manganese content in the fin, the fin remains sacrificial, thus protecting the tube and the galvanic corrosion current remains relatively low so that the fin is not corroded so rapidly in service that the thermal performance of the assembly is compromised.

The above combination of aluminum alloy fins and extruded tubes when assembled and furnace brazed exhibit a very slow and uniform corrosion of exposed fin surfaces, rather than localized pitting of the tube. The invention is particularly useful when the tubes are microport tubes and the assembly has been furnace brazed in an inert atmosphere.

When a brazed heat exchanger is manufactured with these alloy limitations, the heat exchanger tubes can be used without a zincating treatment. The heat exchanger tube does not show self-corrosion in areas remote from the fins (e.g. in between the header and fin pack), and the fins corrode before the tubing but at a rate sufficiently slow to ensure performance of the heat exchanger is maintained for extended periods of time.

BRIEF DESCRIPTION OF THE DRAWINGS

The present invention will be described in conjunction with the following figures.

BEST MODES FOR CARRYING OUT THE INVENTION

Figure 1:
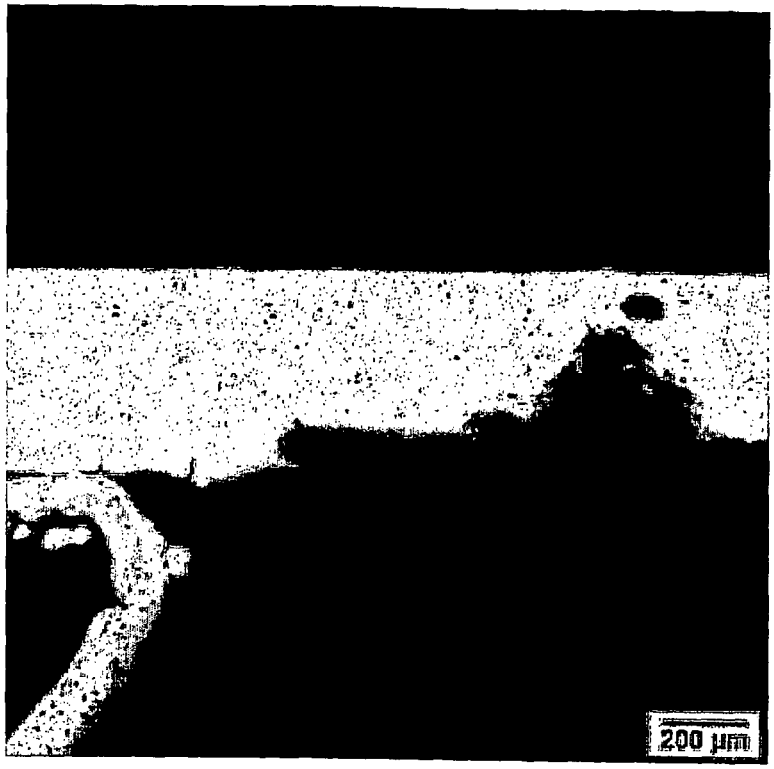
FIG. 1 is a micrograph of a section of a brazed fin and tube assembly of a fin and tube combination outside the scope of this invention.

According to a preferred feature, the fin alloy has less than about 0.05% by weight of copper to make it galvanically compatible with the amount of copper in the extruded tube.

Manganese in the tube alloy in the amount specified provides for good self-corrosion protection, along with adequate mechanical strength yet still permits the tubing to be easily extruded. If the manganese is less than 0.4% by weight the tube itself can corrode when coupled with the fin, and if greater than 1.1% by weight the extrudability of the material is adversely affected. When the manganese levels in the tube alloy is less than the manganese in the fin alloy by less than 0.8% by weight (and preferably by less than 0.6% by weight), or is greater than the manganese in the fin alloy, then the fin remains sacrificial to the tube, the corrosion current remains low and therefore the rate of fin corrosion is acceptable. To meet compatibility requirements under a broad range of conditions, it is preferred that the manganese level in the tube therefore be greater than 0.6% by weight. The conditions on manganese can be expressed as a formula, $$Mn_{tube} > Mn_{fin} - 0.8, \text{ provided that } Mn_{tube} \text{ is in the range 0.4 to 1.1 wt \%}$$

or more preferably $$Mn_{tube} > Mn_{fin} - 0.6, \text{ provided that } Mn_{tube} \text{ is in the range 0.4 to 1.1 wt \%}$$

A particularly preferred tube alloy composition contains 0.9 to 1.1% by weight of manganese, since this represents an alloy that can be extruded into the desired tubes whilst minimizing the manganese concentration differences between tube and fin.

The fin also remains sacrificial to the tube if the manganese content is greater than or equal to that of the tube, but because many commercial fin alloys have Mn levels of about 1%, tube alloys having manganese greater than 1% are less generally useful in the present invention because of increased difficulty in extrudability.

The relative manganese content of the fin and tube alloys can also be expressed by the measured galvanic corrosion current. The measured galvanic corrosion current from the fin to the tube must preferably exceed +0.05 microamps per square centimeter when measured via ASTM G71-81.

The zinc content of the tube must be maintained at a low level to ensure that the fin remains sacrificial to the tube. Even relatively low levels of zinc can alter the galvanic corrosion current and thereby alter this sacrificial relationship. The zinc must therefore be kept at less than 0.05% by weight, more preferably at less than 0.03% by weight.

Iron, silicon, copper and nickel all contribute to self-corrosion of the tube and therefore must be below the stated levels. In addition, iron above 0.2% by weight results in poor extrusion surface quality.

Titanium additions to the alloy make it difficult to extrude and therefore the titanium should be less than 0.05% by weight.

The alloy billets are preferably homogenized between 580 and 620° C. before extrusion into tubes.

EXAMPLE 1

Tests were conducted using the alloys listed in Table 1 below:

TABLE 1

| Alloy | Cu | Fe | Mg | Mn | Ni | Si | Ti | Zn |
|---|---|---|---|---|---|---|---|---|
| A | <.001 | 0.09 | <.001 | 0.22 | <.001 | 0.058 | 0.017 | 0.004 |
| B | 0.014 | 0.07 | <.001 | 0.23 | <.001 | 0.07 | 0.008 | 0.17 |
| C | 0.015 | 0.51 | 0.021 | 0.33 | 0.001 | 0.32 | 0.014 | 0.007 |
| D | 0.001 | 0.08 | <.001 | 0.98 | 0.002 | 0.064 | 0.014 | 0.18 |
| E | 0.015 | 0.09 | <.001 | 1.00 | <.001 | 0.07 | 0.007 | 0.18 |
| F | <.001 | 0.08 | <.001 | 0.98 | 0.001 | 0.071 | 0.008 | 0.005 |
| G | 0.006 | 0.11 | 0.001 | 0.42 | 0.001 | 0.078 | 0.023 | 0.027 |
| H | 0.006 | 0.10 | 0.002 | 0.63 | 0.001 | 0.079 | 0.021 | 0.029 |
| I | 0.001 | 0.09 | <0.001 | 0.61 | 0.002 | 0.08 | 0.016 | 0.002 |
| J | 0.0035 | 0.11 | <0.001 | 0.62 | 0.002 | 0.09 | 0.016 | 0.002 |
| K | 0.08 | 0.59 | <0.001 | 1.05 | <0.001 | 0.23 | 0.01 | 0.01 |

These alloys were cast into 152 mm diameter billets. Alloy C was a commercial 3102 alloy and Alloy K a commercial 3003 alloy. The billets were further machined down to 97 mm in diameter and homogenized between 580 and 620° C. They were then extruded into tubes. Samples of the tubing were subjected to a simulated brazing process and then subjected to a SWAAT test using ASTM standard G85 Annex 3 and galvanic corrosion currents were measured against a standard finstock material manufactured from AA3003 alloy containing 1.5% by weight added zinc and clad with AA4043 alloy that had also been given a simulated braze cycle, in accordance with ASTM G71-81. The results are shown in Table 2 below:

TABLE 2

| Alloy | SWAAT life (days) | Galvanic corrosion current ($\mu A/cm^2$)* |
|---|---|---|
| A | 56 | −3.2 |
| B | <20 | |
| D | 56 | −2.4 |
| E | <20 | |
| F | 56 | 0.2 |
| G | 55 | 3.1 |
| H | 55 | 5 |
| I | 55 | |
| J | 55 | |
| F unhomogenized | 21 | |
| C zincated | 56 | −26.9 |
| K | <5 | |

*+ve corrosion current = current flow from fin to tube
−ve corrosion current = current flow from tube to fin The results of a test carried out on a zincated 3102 tube (e.g. Alloy C, Extruded and zincated) are shown for comparison. In Table 2, a SWAAT life of 55 to 56 days indicated no perforation of the tube by self-corrosion and a positive galvanic corrosion current indicates that the fin corrodes preferentially. A small value indicates a low rate of corrosion. A sample of alloy F was also extruded without homogenization and subjected to a SWAAT test.

Alloys A, D have compositions outside the claimed range. They nevertheless show excellent SWAAT performance indicating that for self-corrosion these alloys would be also be acceptable even when the Mn is less than the range of this invention. It is believed that this is a result of the low Cu, Fe and Ni in these alloys. The amount of Mn present has no significant effect on the self-corrosion behaviour. However, the galvanic corrosion current is unacceptable for these compositions. This is believed to be due to manganese levels that are too low in one case and zinc levels that are too high in the other. Both these elements are important in ensuring acceptable performance of the fin-tube galvanic couple.

Figure 2:
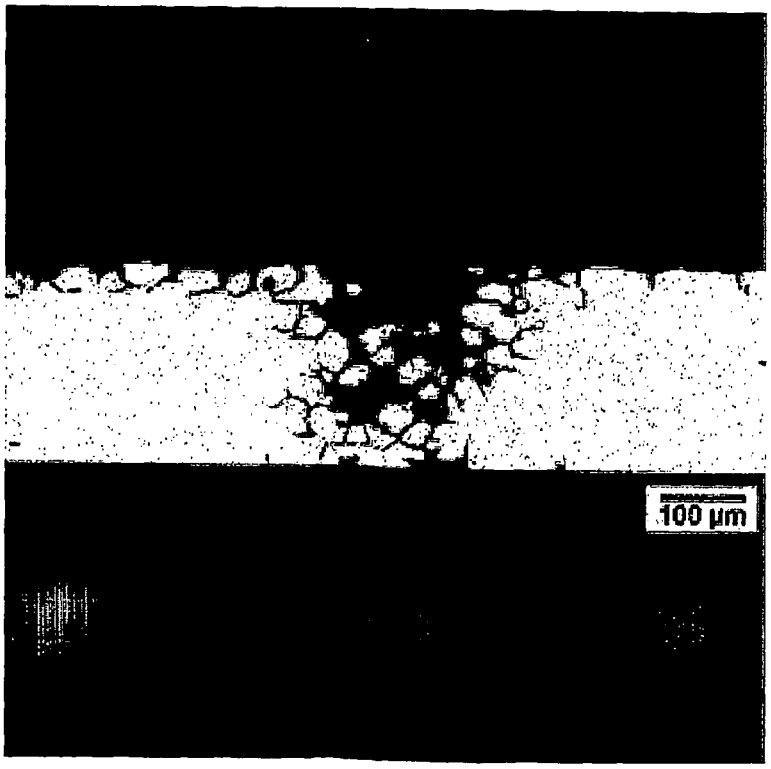
FIG. 2 is a micrograph of a section of a brazed fin and tube assembly of a further fin and tube combination outside the scope of this invention.
Figure 3:
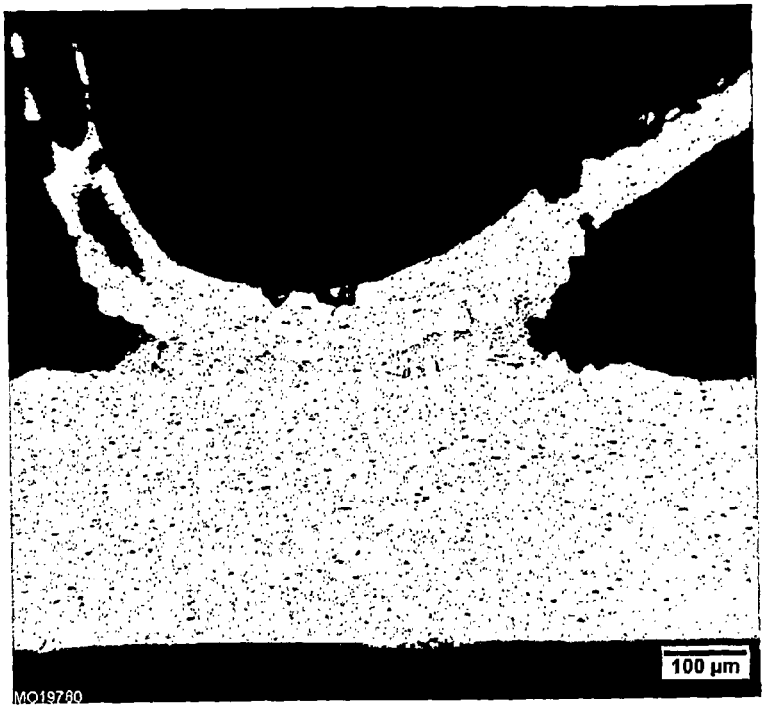
FIG. 3 is a micrograph of a section of a brazed fin and tube assembly of a fin and tube combination within the scope of this invention.

Samples of extruded heat exchanger tubing made from alloys A, D and F were brazed into heat exchanger assemblies using fins manufactured from AA3003 with 1.5% Zn. The AA3003 composition had 1.1% by weight Mn. The assemblies were then exposed to SWAAT testing and examined metallographically. The results are shown in FIGS. 1 to 3. FIGS. 1 and 2, correspond to alloys A and D tubing incorporated into a heat exchanger after 8 and 7 days exposure respectively to the SWAAT test. Substantial pitting corrosion of the tubes near the fin is observed, although in tests of the tube alone, no pitting occurred after long exposure. Figure shows a combination of tubing of Alloy F with the same fin stock (i.e. a combination within the scope of this invention), in which there was no through-thickness pitting until after 20 days SWAAT exposure (compared to 7 or 8 days for the combinations outside the scope of the invention). A 20 day life is considered under this test to be adequate performance.

Alloys B, E and K have copper outside the desired range and show poor SWAAT results, indicating that alloys with such a copper level would suffer from excessive self-corrosion, whether or not the manganese composition met the requirements. Alloy D has a zinc level that exceeds the desired range and shows that although the manganese level is within the desired range, the fin-tube galvanic corrosion current is negative and the tube would therefore corrode first. The self-corrosion performance (SWAAT test) is acceptable, but because of the fin-tube galvanic corrosion, the overall assembly would fail. Alloy K also has Fe and Si above the required amounts.

Alloys F, G, I and J lie within the claimed range. Alloys F, G and H exhibits acceptable performance on both the SWAAT tests on the tubing and the galvanic corrosion behaviour. Alloys I and J show good SWAAT behaviour, and lack any significant-levels of elements that would give poor galvanic current performance.

Alloy F in un-homogenized condition however, shows unacceptable SWAAT performance indicating that homogenization of the product is a preferred process step to achieve good performance.

Finally Alloy C was a standard tube alloy and was tested in zinc-coated form. As expected this gave good SWAAT performance, since the zinc layer is sacrificial to the entire tube and so overcomes the negative effects of elements such as copper. The negative galvanic corrosion current in this case indicates that the zinc surface layer is sacrificial as noted above. Alloy C had manganese less than the desired range and only performs because of the presence of the zinc coating. However, as noted above, zinc has a number of negative features that mean it is not used in the present invention.

EXAMPLE 2

Figure 4:
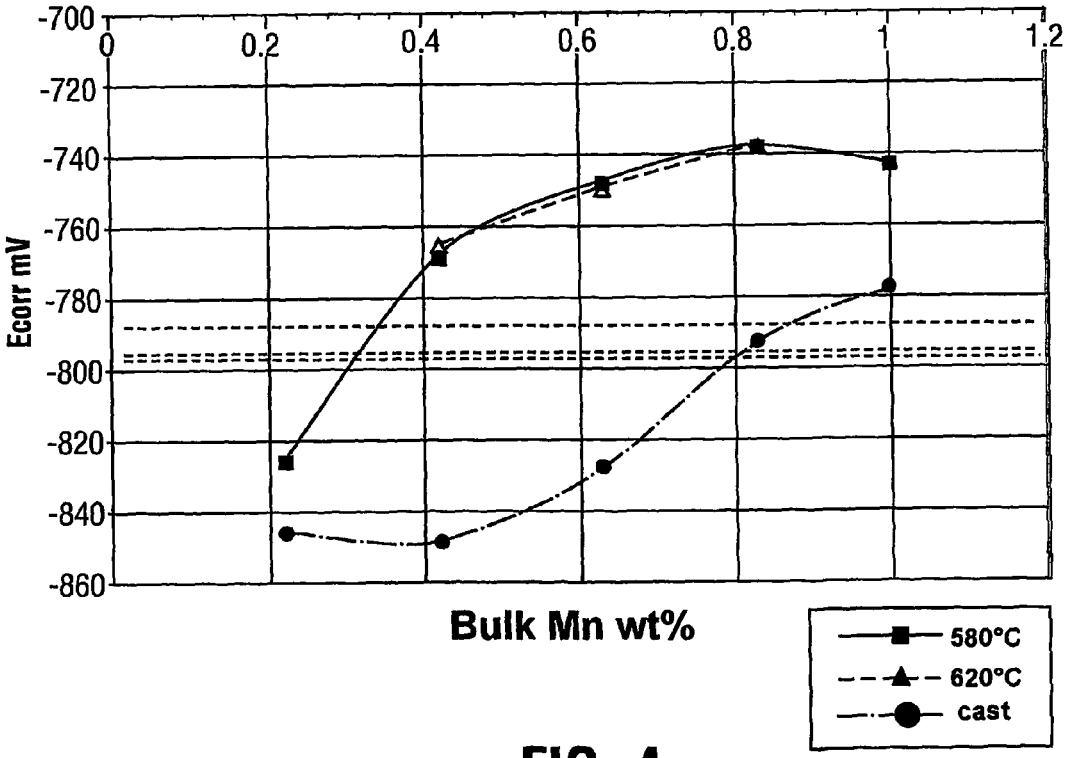
FIG. 4 is a graph of corrosion potential as a function of manganese content of various extruded tubes and fin materials showing the relationship between manganese content and corrosion behaviour.

In order to show the effect of changes in fin Mn composition, the corrosion potential of the various tube alloys of Example 1 were compared to the corrosion potential of various fin alloys. A necessary condition for the fin to be sacrificial with respect to the tube is that the tube corrosion potential be clearly less negative than the fin corrosion potential. The corrosion potential of the tube alloys of Example 1 were determined and plotted on a graph in FIG. 4 showing the variation with manganese content. Curves are shown for the tube alloys in the as-cast condition as well as following homogenization at 580 or 620° C.

Various fin alloys (identified as samples 1 to 3) based on the commercial AA3003 with 1.5% Zn composition, but having different Mn compositions within the preferred Mn range of the present invention, were prepared by book mould casting, processed to finstock gauge by hot and cold rolling. They were then subjected to a simulated braze cycle and the corrosion potential measured. The compositions and measured corrosion potentials are given in Table 3.

TABLE 3

| Sample No | Cu | Fe | Mg | Mn | Ni | Si | Ti | Zn | $E_{corr}$ (mV) |
|---|---|---|---|---|---|---|---|---|---|
| 1 | 0.12 | 0.53 | 0.010 | 1.08 | 0.004 | 0.29 | 0.011 | 1.50 | −790 |
| 2 | 0.133 | 0.55 | 0.0003 | 0.9 | 0.002 | 0.34 | 0.007 | 1.61 | −797 |
| 3 | 0.13 | 0.55 | 0.0004 | 1.24 | 0.002 | 0.33 | 0.006 | 1.63 | −786 |

The corrosion potentials for samples 1 to 3 are shown as horizontal dashed lines on FIG. 4. In order that the fin material be sacrificial compared to the tube alloy the fin corrosion potential must be more negative that the tube alloy corrosion potential. For practical reasons and to account for inevitable variation in materials, only tube alloy compositions that have corrosion potentials that exceed (are less negative than) those of the fin by 25 mV are selected. From FIG. 4, therefore, the minimum tube manganese level compatible with each of the three fin manganese compositions is determined. These are given in Table 4, along with the corresponding tube manganese composition and the minimum acceptable tube manganese in accordance with the formula:

$$Mn_{tube} > Mn_{fin} - 0.8 \text{ wt } \% \text{ except } 0.4 <= Mn_{tube} <= 1.1 \text{ wt } \%$$

TABLE 4

| Fin sample | Mn in fin | Measured minimum acceptable Mn in tube | Calculated minimum acceptable Mn in tube |
|---|---|---|---|
| 1 | 1.08 | 0.43 | 0.40 |
| 2 | 0.9 | 0.40 | 0.40 |
| 3 | 1.24 | 0.48 | 0.44 |

The invention claimed is:

1. A brazed heat exchanger assembly comprising extruded heat exchanger tubes joined to heat exchanger fins;

wherein said heat exchanger tubes are formed of a first aluminum alloy comprising 0.4 to 1.1% percent by weight manganese, up to 0.01% by weight copper, up to 0.05% by weight zinc, up to 0.2% by weight iron, up to 0.2% by weight silicon, up to 0.01% by weight nickel, up to 0.05% by weight titanium, and a balance of aluminum and incidental impurities;

wherein said heat exchanger fins are formed of a second aluminum alloy comprising 0.9 to 1.5% by weight manganese and at least 0.5% by weight zinc;

wherein the heat exchanger tubes exhibit good self corrosion protection and the heat exchanger fins are galvanically sacrificial relative to the heat exchanger tubes; and wherein the manganese weight percent of the first aluminum alloy is related to the manganese weight percent of the second aluminum alloy by the formula $$Mn_{tube}(\text{wt } \%) > Mn_{fin}(\text{wt } \%) - 0.8 \text{ wt } \%$$

where $Mn_{tube}$ is the manganese weight percent of the first aluminum alloy and $Mn_{fin}$ is the manganese weight percent of the second aluminum alloy.

2. A brazed heat exchanger assembly according to claim 1, wherein the second aluminum alloy further comprises less than 0.05% by weight copper.

3. A brazed heat exchanger assembly according to claim 1, where a galvanic current from fin to tube is greater than +0.05 microamps per square centimeter.

4. A brazed heat exchanger assembly according to claim 1, wherein the manganese weight percent of the first aluminum alloy is between 0.6 and 1.19%.

5. A brazed heat exchanger assembly according to claim 4 where the manganese weight percent of the first aluminum alloy is between 0.9 and 1.1%.

6. A brazed heat exchanger assembly according to claim 1, wherein the second aluminum alloy is an AA3003 alloy having added zinc to produce a zinc content of said at least 0.5% by weight.

* * * * *